US008974026B2

(12) United States Patent
Iwama

(10) Patent No.: US 8,974,026 B2
(45) Date of Patent: Mar. 10, 2015

(54) LIQUID DROPLET EJECTION HEAD, CONTROL DEVICE, CONTROL METHOD, AND MANUFACTURING METHOD OF THE SAME, AND RECORDING MEDIUM OF THE SAME METHODS

(71) Applicant: Masami Iwama, Kanagawa (JP)

(72) Inventor: Masami Iwama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/311,562

(22) Filed: Jun. 23, 2014

(65) Prior Publication Data

US 2014/0375712 A1 Dec. 25, 2014

(30) Foreign Application Priority Data

Jun. 24, 2013 (JP) ..... 2013-131882

(51) Int. Cl.

| | |
|---|---|
| ***B41J 29/38*** | (2006.01) |
| ***B41J 29/393*** | (2006.01) |
| ***B41J 2/045*** | (2006.01) |
| ***B41J 2/16*** | (2006.01) |

(52) U.S. Cl.

CPC ..... *B41J 2/04541* (2013.01); *B41J 2/1625* (2013.01)

USPC ..... 347/10; 347/17; 347/19

(58) Field of Classification Search

CPC .... B41J 2/04563; B41J 2/0457; B41J 2/0458; B41J 29/393; B41J 2/04541; B41J 2/04565

USPC ..... 347/5, 9–11, 17, 19

See application file for complete search history.

(56) References Cited

U.S. PATENT DOCUMENTS

| | | | | |
|---|---|---|---|---|
| 6,074,034 | A | 6/2000 | Maeda | |
| 6,113,218 | A | 9/2000 | Atobe et al. | |
| 6,709,083 | B2 * | 3/2004 | Fukushima | 347/17 |
| 7,029,087 | B2 * | 4/2006 | Tamura | 347/17 |
| 8,360,637 | B2 * | 1/2013 | Kato | 374/183 |

FOREIGN PATENT DOCUMENTS

| | | |
|---|---|---|
| JP | S61-059911 | 3/1986 |
| JP | S62-082043 | 4/1987 |
| JP | H02-289354 | 11/1990 |
| JP | H06-071882 | 3/1994 |

* cited by examiner

*Primary Examiner* — An Do

(74) *Attorney, Agent, or Firm* — Cooper & Dunham LLP

(57) ABSTRACT

A control device of controlling a liquid droplet ejection head includes a head substrate; a head controller applying a drive voltage to the head substrate to control the ejection of liquid droplets; a relay substrate connecting the head substrate and the head controller; a main-body controller controlling the head controller; and a voltage conversion circuit disposed in the relay substrate. Further, the voltage conversion circuit converts a resistance value in accordance with a temperature of the head substrate into an output voltage, the relay substrate inputs the output voltage into the main-body controller, and the main-body controller detects the temperature based on the output voltage and determines the drive voltage based on the detected temperature.

10 Claims, 5 Drawing Sheets

LIQUID DROPLET EJECTION HEAD, CONTROL DEVICE, CONTROL METHOD, AND MANUFACTURING METHOD OF THE SAME, AND RECORDING MEDIUM OF THE SAME METHODS

CROSS-REFERENCE TO RELATED APPLICATIONS

The present application is based on and claims the benefit of priority under 35 U.S.C. §119 of Japanese Patent Application No. 2013-131882 filed Jun. 24, 2013, the entire contents of which are hereby incorporated herein by reference.

BACKGROUND OF THE INVENTION

1. Field of the Invention

The present invention generally relates to a control device of a liquid droplet ejection head, and a control method and a manufacturing method of the liquid droplet ejection head.

2. Description of the Related Art

To form an image (print characters or print an image) on a surface of a recording medium, a liquid droplet ejection head may be used. Herein, the term "liquid droplet ejection head" refers to a device or the like that ejects (discharges) liquid droplets (e.g., ink droplets) through a plurality of respective ejection openings (nozzles) by applying a pressure to the liquid. Further, some liquid droplet ejection heads may detect a temperature thereof and control the ejection operation based on the detected temperature.

Japanese Laid-open Patent Publication No. H02-289354 discloses a technique of a liquid injection recording head (liquid droplet ejection head) in which an electro-thermal conversion body, which generates thermal energy to be used for ejecting liquid therefrom and a temperature detection device, which detects a temperature of the electro-thermal conversion body, are mounted on the same supporting body.

SUMMARY OF THE INVENTION

According to an aspect of the present invention, a control device of controlling an operation of a liquid droplet ejection head includes a head substrate having a plurality of ejection openings; a head controller applying a drive voltage to the head substrate to control an operation of ejecting liquid droplets from the ejection openings; a relay substrate electrically connecting the head substrate and the head controller to each other; a main-body controller controlling an operation of the head controller; and a voltage conversion circuit disposed in the relay substrate.

Further, the voltage conversion circuit converts a resistance value, which changes in accordance with a temperature of the head substrate, into an output voltage, the relay substrate inputs the output voltage into the main-body controller, and the main-body controller detects the temperature based on the output voltage input to the main-body controller and determines the drive voltage based on the temperature detected by the main-body controller.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Figure 1:
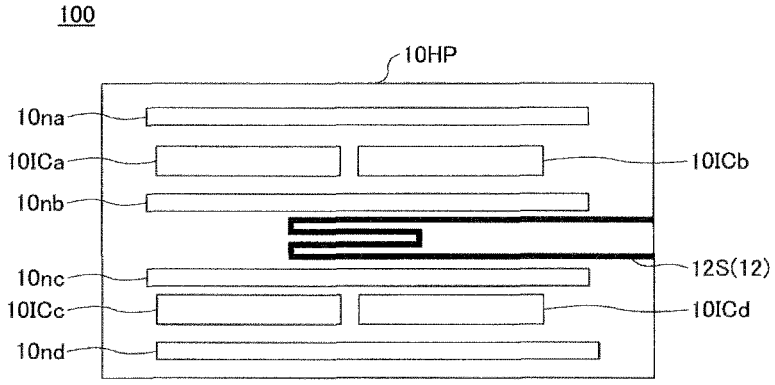
FIG. 1 is a schematic top view of an example liquid droplet ejection head according to an embodiment of the present invention.

In the related technologies of the liquid droplet ejection head, in order to improve quality of an image to be formed, it is desired to more accurately control the liquid droplet ejection operation (discharge operation) of the liquid droplet ejection head. Along with the desire for the accurate control of the ejection operation, it is also desired to more accurately detect the temperature of the liquid droplet ejection head (hereinafter may be simplified as "head").

However, in the related technologies (e.g., Japanese Laid-open Patent Publication No. H02-289354) of the liquid droplet ejection head, an overall resistance value is detected of the liquid droplet ejection head and the transmission path (e.g., the Flexible Flat Cable (FFC)) between the temperature detection device and the control section. Due to this, the detection value may include an error.

Namely, in this case, if, for example, the wiring distance of the transmission path is long, the impedance of the transmission path is high, or the transmission path is subject to influence of disturbance (e.g., noise), it may become difficult to accurately detect the temperature.

The present invention is made in light of this problem, and may provide a control device of a liquid droplet ejection head, a liquid droplet ejection head, a control method of the liquid droplet ejection head, and a manufacturing method of the liquid droplet ejection head in which it becomes possible to highly accurately detect the temperature based on an output voltage that changes in accordance with a temperature change.

With the descriptions below of a liquid droplet ejection head that ejects liquid as liquid droplets from the ejection openings (nozzles) thereof, non-limiting example embodiments of the present invention are described. Here, it should be noted that the present invention is applied to not only the liquid droplet ejection head described below but also, for example, a copier, a multifunction peripheral, a printer, a scanner, a plotter, a facsimile machine, and other image forming means (i.e., device, apparatus, unit, system, etc.) that form an image on a surface of a recording medium. Herein, the term "form an image on a surface of a recording medium" includes printing, imaging, and recording an image and printing characters.

Further, besides the liquid droplet ejection head described below, the present invention may also be applied to a forming unit that forms a three-dimensional shape (e.g., three-dimensional (3D) forming device). Here, the term "forming a three-dimensional shape" includes the forming of a DNA sample, a resist, a pattern material, and an object having a fine shape such as wires.

Further, in the following descriptions, the same or relevant reference numerals may be used throughout the figures to describe the same or equivalent members and parts. Further, the figures are not intended to illustrate the relative ratio between members or parts. Therefore, it becomes possible for a person skilled in the art to determine the specific sizes of the members and parts in the figures based on a non-limiting embodiment described below.

With reference to a liquid droplet ejection head according to an embodiment, the present invention is described in the following order.

1. Configuration of the liquid droplet ejection head
2. Control device of the liquid droplet ejection head
3. Example temperature detection unit
4. Control method of the liquid droplet ejection head
5. Manufacturing method of the liquid droplet ejection head
6. Program and recording medium 1. Configuration of the Liquid Droplet Ejection Head With reference to FIG. 1, an example of the liquid droplet ejection head according to an embodiment is described. Here, FIG. 1 is a schematic top view of an example configuration of a liquid droplet ejection head 100 (i.e., a surface to eject liquid droplets) according to an embodiment of the present invention. It should be noted that the liquid droplet ejection head according to the present invention is not limited to this configuration.

As illustrated in FIG. 1, the liquid droplet ejection head 100 includes rows (four rows in this embodiment) 10*na*, 10*nb*, 10*nc*, and 10*nd*, each having a plurality of ejection openings (hereinafter may be "ejection-opening rows 10*na*, 10*nb*, 10*nc*, and 10*nd*") to eject liquid droplets from a head substrate 10HP. For example, the four rows of ejection openings (10*na*, 10*nb*, 10*nc*, and 10*nd*) may be eject black (K), yellow (Y), magenta (M), and cyan (C) color liquid droplets, respectively.

The liquid droplet ejection head 100 further includes drive Integrated Circuits (ICs) 10ICa, 10ICb, 10ICc, and 10ICd that control the operations of ejecting liquid droplets from the ejection-opening rows 10*na*, 10*nb*, 10*nc*, and 10*nd*, respectively. Here, when a thermal ejection method is used, the drive ICs 10ICa, 10ICb, 10ICc, and 10ICd control respective power levels supplied to a thermal source (head substrate 10HP).

The liquid droplet ejection head 100 according to this embodiment causes the drive ICs 10Ica, 10ICb, 10ICc, and 10ICd to control the ejection of respective liquid droplets from the ejection openings of the head substrate 10HP so that the liquid droplets are ejected at desired timings from desired ejection openings.

The liquid droplet ejection head 100 further includes a temperature detection unit (i.e., a voltage conversion circuit 12S described below) provided on a surface of a relay substrate 12 (described below with reference to FIG. 2) on the side contacting the head substrate 10HP. Here, the temperature detection unit (the voltage conversion circuit 12S) refers to a circuit to change an output voltage (hereinafter "output voltage "Vs"") in accordance with a resistance value that changes in association with a change of the temperature of the head substrate 10HP.

Namely, the liquid droplet ejection head 100 according to this embodiment detects the temperature of the head substrate 10HP as a temperature of a head unit by using the temperature detection unit (the voltage conversion circuit 12S). A specific example of the temperature detection unit (the voltage conversion circuit 12S) is described in the section "3. Example temperature detection unit" below.

The liquid droplet ejection head 100 according to this embodiment or a device including the liquid droplet ejection head 100 may further include an operation section (e.g., operation buttons, an operation panel, a touch panel, etc.) (not shown). Here, the term "operation buttons" refer to, for example, buttons to input operating conditions by an operator (or user). The term "operation panel" refers to, for example, a panel (e.g., a Liquid Crystal Display (LCD), a Light-Emitting Diode (LED), etc.) to display an operating state or an operation result of the liquid droplet ejection head 100.

When the liquid droplet ejection head 100 is driven (i.e., when liquid droplets are ejected), the temperature of the head unit (including the head substrate 10HP) and the temperature of liquid ("ink temperature") in the head unit are increased by heat generation due to electric resistance and friction resistance of a piezoelectric element, heat generation due to electric resistance of wiring patterns, etc., and heat generation of the drive ICs and the like.

Namely, due to the temperature increase of the liquid (ink), the viscosity of the liquid (ink) is decreased while the liquid droplet ejection head 100 is driven. In this case, if the ejection operation of the liquid droplet ejection head 100 is controlled with the same drive waveform between before and after the temperature increase, the shape, the volume, etc., of the ejected ink droplets change due to the change of the viscosity of the liquid (ink). As a result, the ejection characteristics i.e., print quality) may be degraded (impaired).

The liquid droplet ejection head 100 according to this embodiment detects the temperature of the head unit (including the head substrate 10HP) based on the output voltage "Vs" output from the temperature detection unit (the voltage conversion circuit 12S). Further, the liquid droplet ejection head 100 according to this embodiment appropriately changes (selects) a drive voltage (drive waveform) based on the detected temperature to realize (obtain) desired ejection characteristics (print quality). A specific example of the liquid droplet ejection operation of the liquid droplet ejection head 100 is described in the section "4. Control method of the liquid droplet ejection head" below.

2. Control Device of the Liquid Droplet Ejection Head

Figure 2:
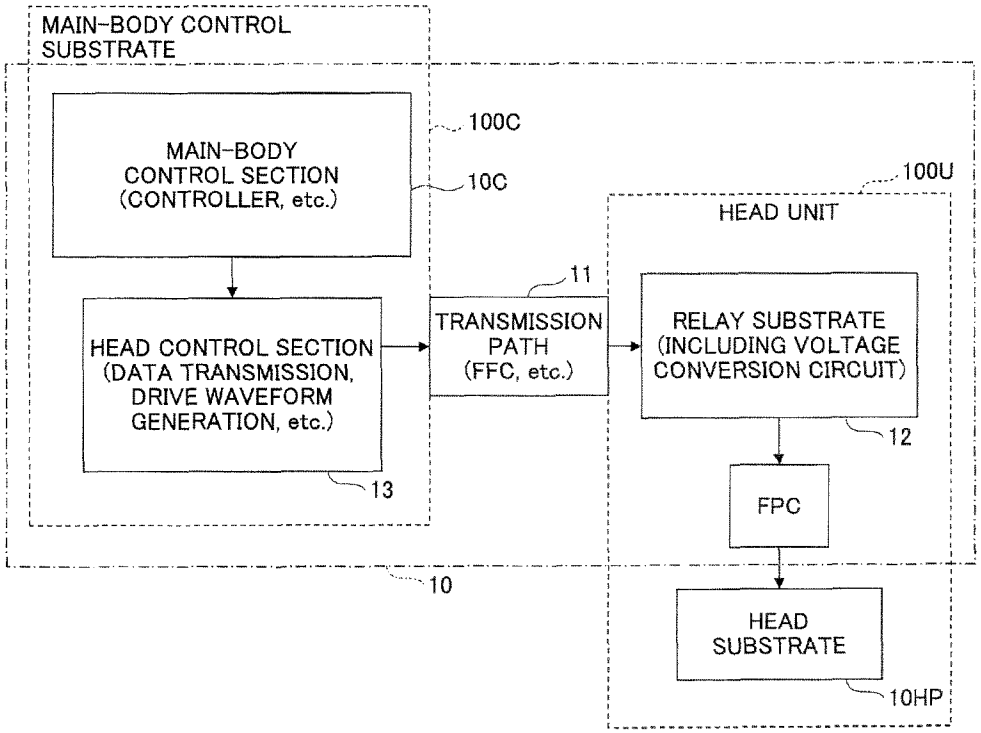
FIG. 2 is a functional block diagram of an example configuration of the liquid droplet ejection head according to an embodiment.

With reference to FIG. 2, a control device 10 of the liquid droplet ejection head 100 according to this embodiment is described. FIG. 2 is a schematic functional block diagram of an example configuration of the liquid droplet ejection head according to an embodiment. It should be noted that the functions of the liquid droplet ejection head 100 in the present invention are not limited to the functions described in FIG. 2.

As illustrated in FIG. 2, the liquid droplet ejection head 100 includes the control device 10. Here, the control device 10 refers to a device that sends instructions to the elements of the liquid droplet ejection head 100 to control the operations of the elements. Further, as illustrated in FIG. 2, in the following descriptions, a combination including the head substrate 10HP and the relay substrate 12 is called a head unit 100U. Further, a main-body control section (main-body controller) 10C and a head control section (head controller) 13 are mounted on a main-body control substrate 100C.

The control device 10 in this embodiment includes the head control section 13, which applies a drive voltage to the head substrate 10HP, the main-body control section 10C, which controls the operations of the head control section 13, and the relay substrate 12 that electrically connects the head substrate 10HP and the head control section 13 to each other. Here, the main-body control section 10C and the head substrate 10HP are connected to each other via a Flexible Printed Circuit (FPC).

The main-body control section 10C is electrically connected to the head control section 13. The main-body control section 10C controls the operations of the head unit 100U (head control section 13) and the like based on the operating conditions which are input to the liquid droplet ejection head 100. The main-body control section 10C inputs (transmits) the information indicating, for example, the drive voltage (drive waveform) to the head control section 13.

Further, the main-body control section 10 according to an embodiment detects the temperature of the head unit 100U (head substrate 10HP) based on the output voltage "Vs" which is output from the relay substrate 12 (i.e., the temperature detection unit described below). The main-body control section 10C inputs (receives) the output voltage "Vs", which is illustrated, for example, in line "La" of FIG. 6 described blow, from the relay substrate 12. Namely, main-body control section 10C inputs (receives) the output voltage "Vs" which changes in accordance with the temperature of the head substrate 10HP.

Figure 6:
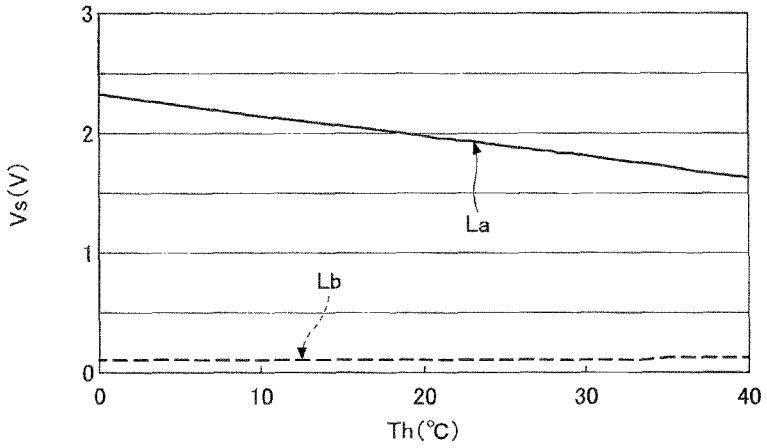
FIG. 6 is a graph illustrating an example of a detection result (output voltage) of the temperature detection unit (voltage conversion circuit) of the liquid droplet ejection head according to an embodiment.

In this case, the main-body control section 10C stores in advance the relationship data between the output voltage "Vs" which is input to the main-body control section 10C (the vertical axis of FIG. 6) and the temperature of the head unit 100U (head substrate 10HP) (the horizontal axis of FIG. 6). The main-body control section 10C detects the temperature of the head unit 100U (head substrate 10HP) based on the input (received) value of the output voltage "Vs".

Further, since the main-body control section 100 can detect the temperature of the head unit 100U (head substrate 10HP), the main-body control section 10C sets (selects) an appropriate drive voltage (drive waveform) based on the detected temperature. By doing this, it becomes possible for the liquid droplet ejection head 100 (the main-body control section 10C) to realize (set) desired ejection characteristics (i.e., print quality) based on the temperature of the head unit 100U (head substrate 10HP).

Further, for example, the main-body control section 10C may use a program (e.g., a control program, an application program, etc.) stored in advance to control the operations of the elements of the liquid droplet ejection head 100 (such as the head unit 100U, etc.). Further, for example, the main-body control section 10C may further use the information which is input by a user via the operation section to control the operations of the elements of the liquid droplet ejection head 100.

The relay substrate 12 is provided (used) to electrically connect the main-body control substrate 100C and the head unit 100U to each other. Also, the relay substrate 12 is provided (used) to electrically connect the head control section 13 and the head substrate 10HP to each other.

The relay substrate 12 according to an embodiment further includes the temperature detection unit (i.e., the voltage conversion circuit 12S of FIG. 3 described below) to detect the temperature of the head unit 100U (the head substrate 10HP in this embodiment). The relay substrate 12 inputs (transmits) the detection result, which is detected by the temperature detection unit, (i.e., the output voltage "Vs" from the voltage conversion circuit 12S) into the main-body control section 10C (the main-body control substrate 100C).

By doing this, in the liquid droplet ejection head 100 according to this embodiment, it becomes possible to detect the temperature of the head unit 100U (the head substrate 10HP) based on the detection result, which is detected by the temperature detection unit, (i.e., the output voltage "Vs" from the voltage conversion circuit 120).

Further, in the liquid droplet ejection head 100 according to this embodiment, since the temperature of the head unit 100U can be detected based on the detection result which is detected by the temperature detection unit, it is not necessary to mount an element (part) dedicated to detecting the temperature such as a thermistor or the like.

Further, in the liquid droplet ejection head 100 according to this embodiment, since it is not necessary to mount an element (part) dedicated to detect the temperature such as a thermistor or the like, it becomes possible to effectively reduce the size and the cost of the liquid droplet ejection head 100. An example of the temperature detection unit (the voltage conversion circuit 12S) is described in the section "3. Example temperature detection unit" below.

Further, the relay substrate 12 may further include a storage section (not shown). When the relay substrate 12 includes the storage section, the relay substrate 12 may store the detection result which is detected by the temperature detection unit (e.g., a correction value, etc.). Further, in a case where the relay substrate 12 includes the storage section, the relay substrate 12 may store in advance a value of a voltage which is output from the voltage conversion circuit 12S (an example of the temperature detection unit) when, for example, the temperature of the head substrate 10HP is at a predetermined temperature "Ts" (hereinafter, the voltage may be referred to as a "reference voltage").

By storing the detection result and/or the reference voltage in the storage section in advance, it becomes possible for the liquid droplet ejection head 100 (the main-body control section 10C) to read the detection result and/or the value of the reference voltage stored in the storage section of the relay substrate 12 of the head unit 100U when, for example the head unit 100U is exchanged. Further, the liquid droplet ejection head 100 (the main-body control section 10C) may store the detection result and/or the value of the reference voltage into the storage section of the relay substrate 12 of the head unit 100U when, for example, the liquid droplet ejection head 100 is manufactured.

Here, the predetermined temperature "Ts" may be defined as the temperature which is determined based on the resistance values of the voltage conversion circuit 12S and a transmission path 11 (see FIG. 2) and other specifications of the liquid droplet ejection head 100. Further, the predetermined temperature "Ts" may be defined as the temperature which is set in the "5. Manufacturing method of the liquid droplet ejection head" described below (for example, when heat is applied while the head control section 13 and the relay substrate 12 are sealed).

Further, the predetermined temperature "Ts" may be defined as the temperature of the head unit 1000 when it is desired to correct (adjust), for example, the variation of the resistance values of the wires in the liquid droplet ejection head 100 when the liquid droplet ejection head 100 is manufactured and the variation of the resistance value(s) of the voltage conversion circuit 12S.

The relay substrate 12 may further include an analog-to-digital (A/D) conversion circuit (not shown). Namely, when the relay substrate 12 includes the A/D conversion circuit, the relay substrate 12 may convert the output voltage "Vs", which is output from the voltage conversion circuit 12S (temperature detection unit), into digital data.

Further, when the relay substrate 12 includes the A/D conversion circuit, the relay substrate 12 may input (transmit) the digital data converted by the A/D conversion circuit into the main-body control section 10C (the main-body control substrate 100C). Namely, since the liquid droplet ejection head 100 can convert the value of the output voltage "Vs" which is output from the voltage conversion circuit 12S into the digital data, the liquid droplet ejection head 100 can reduce the risk that disturbance (e.g., noise) is included into the detection result (and output voltage "Vs").

Especially, since the liquid droplet ejection head 100 can transmit a digital signal (digital data) where the risk to receive the influence of disturbance can be reduced without transmitting an analog signal to the transmission path 11 (the FFC, etc.) which is subject to, for example, the influence of disturbance, it becomes possible to improve the accuracy of the detected temperature.

The head control section 13 is a substrate (base board) which is electrically connected to the head substrate 10HP via the relay substrate 12. Further, the head control section 13 controls the ejection operation of the head substrate 10HP based on the information which is input from the main-body control section 10C.

Specifically, the head control section 13 generates drive voltages to be applied to the head substrate 10HP, by using the drive ICs 10ICa, 10ICb, 10ICc, and 10ICd of FIG. 1, based on the information related to the drive waveform which is input from the main-body control section 10C, and applies the generated drive voltages to the head substrate 10HP. By doing this, the head control section 13 can control the operation of ejecting droplets from the openings of the head substrate 10HP (i.e., the ejection operation).

3. Example Temperature Detection Unit

Figure 3:
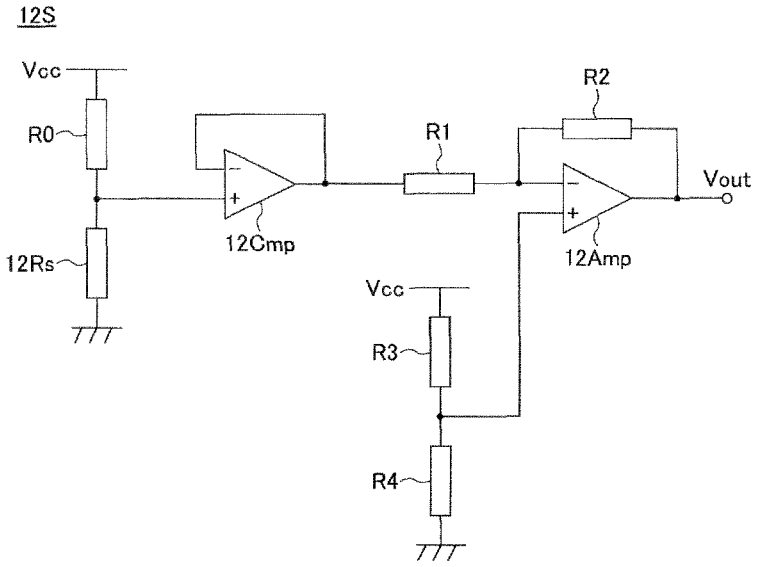
FIG. 3 is a schematic circuit diagram of an example temperature detection unit (voltage conversion circuit) of the liquid droplet ejection head according to an embodiment.

An example of the temperature detection unit of the liquid droplet ejection head 100 according to an embodiment is described with reference to FIG. 3. FIG. 3 illustrates an example of the voltage conversion circuit 12S as the temperature detection unit used in the liquid droplet ejection head 100. In FIG. 3, for example, the input voltage "Vcc" may be 3.3 V and the resistances of the voltage dividing resistors "R0", "R1", "R2", "R3", and "R4" may be 100 Ω, 1 kΩ, 47 kΩ, 3.3 kΩ, and 150Ω, respectively. It should be noted that the temperature detection unit according to the present invention is not limited to the voltage conversion circuit 12S illustrated in FIG. 13.

As illustrated in FIG. 3, the temperature detection unit (the voltage conversion circuit 12S) of the liquid droplet ejection head 100 includes a resistor 12Rs whose resistance value changes in accordance with the temperature change. Further, the temperature detection unit converts the input voltage "Vcc" into the output voltage "Vs" ("Vout" in FIG. 3) and outputs the output voltage "Vs" ("Vout"). Namely, the temperature detection unit uses the resistor 12Rs whose resistance value changes in accordance with the temperature change and outputs the output voltage "Vs" ("Vout") which corresponds to the temperature change (resistance value change).

More specifically, as illustrated in FIG. 3, the voltage conversion circuit 12S (temperature detection unit) applies the input voltage "Vcc" to the resistor 12Rs, whose resistance value changes in accordance with the temperature change, and the voltage dividing resistor "R0". When the temperature changes (i.e., when the resistance value of the resistor 12Rs changes), the voltage conversion circuit 12S uses a comparator 12Cmp (see FIG. 3) to convert the changed amount of the resistance value of the resistor 12Rs due to the temperature change into a change amount of a voltage value.

Then, the voltage conversion circuit 12S uses an amplifier 12Amp to amplify the change amount of the voltage value by comparing the output voltage of the comparator 12Cmp with a voltage which is determined based on the input voltage "Vcc" and the voltage dividing resistors "R3" and "R4". Then, the voltage conversion circuit 12S outputs the amplified voltage (the change amount of the voltage) as the output voltage "Vs" ("Vout") which corresponds to the temperature change.

The temperature detection unit according to an embodiment (i.e., the voltage conversion circuit 12S) outputs the output voltage "Vs" to the main-body control section 10C via the transmission path 11. In this case, for example, as illustrated in the line "La" of FIG. 6, the temperature detection unit outputs the output voltage "Vs" (the vertical axis) corresponding to the temperature "Th" of the head unit 100U (the horizontal axis). Here, when the temperature detection unit includes the A/D conversion circuit, the temperature detection unit may converts the output voltage "Vs" into digital data.

4. Control Method of the Liquid Droplet Ejection Head

Next, an example operation of ejecting liquid droplets (push-pull operation in a piezoelectric method) by the liquid droplet ejection head 100 according to an embodiment is described. Here, it should be noted that the operation of ejecting liquid droplets by the liquid droplet ejection head 100 according to the present invention is not limited to the operations described below.

Namely, for example, the operation of ejecting liquid droplets (push-pull operation in a piezoelectric method) by the liquid droplet ejection head 100 according to an embodiment may be based on a method in which a heat generation resistor is used to heat liquid to generate bubbles therein (so-called thermal type) (see, for example, Japanese Laid-open Patent publication No. S61-59911), or a method in which an electrostatic force is used to apply a pressure onto the liquid (so-called electrostatic type) (see, for example, Japanese Laid-open Patent publication No. H06-71882).

Based on the information input by a user via the operation section or the like, the main-body control section 10C (see FIG. 2) of the liquid droplet ejection head 100 starts the operation of ejecting liquid droplets. Namely, based in the input information, the main-body control section 10C outputs the information of the drive waveform(s) (drive voltage(s)) into the head control section 13 (FIG. 2).

Next, the head control section 13 uses the drive ICs 10ICa, 10ICb, 10ICc, and 10ICd (FIG. 1) to generate respective drive voltages corresponding to the drive waveform(s) and applies the generated drive voltage(s) to the head substrate 10HP. Base on this operation, the head substrate 10HP ejects liquid droplets through the ejection openings (nozzles) in accordance with the input drive waveform(s).

Specifically, as the drive voltage to be applied, first, the head control section 13 reduces the voltage applied to the head substrate 10HP to be less than a reference potential (voltage) to shrink (retract) the piezoelectric element in the head substrate 10HP. In this case, due to the shrinkage of the piezoelectric element, the volume (capacity) of a liquid chamber in the head substrate 10HP is increased (expanded). By doing this, it becomes possible for the head control section 13 to supply liquid (e.g., ink) to refill the liquid chamber of the head substrate 10HP.

Next, the head control section 13 increases the voltage applied to the head substrate 10HP to be greater than the reference potential to expand (project) the piezoelectric element of the head substrate 10HP. In this case, due to the expansion of the piezoelectric element, the volume (capacity)

of a liquid chamber in the head substrate 10HP is reduced (shrunk). By doing this, it becomes possible for the head control section 13 to apply pressure to liquid in the liquid chamber, so as to eject (inject) liquid in the liquid chamber through the ejection openings (nozzles).

After that, the head control section 13 sets the voltage applying to the piezoelectric element back to the reference potential to return (restore) the piezoelectric element back to the original position (state). In this case, the head substrate 10HP reduces the pressure in the liquid chamber due to the expansion of the liquid chamber, so as to supply liquid (e.g., ink) to refill the liquid chamber. Next, the head control section 13 repeats the operation of ejecting liquid droplets based on the information related to the drive waveform(s) (drive voltage(s)) input from the main-body control section 10C.

The liquid droplet ejection head 100 (the main-body control substrate 100C) according to an embodiment detects the temperature of the head unit 100U (FIG. 2) by using the temperature detection unit and controls the ejection operation based on the detected temperature while driving (i.e., while ejecting liquid droplets). Namely, the main-body control section 10C (the main-body control substrate 100C) detects the temperature of the head substrate 10HP (the head unit 100U) based on the output voltage "Vs" output from the voltage conversion circuit 12S (the temperature detection unit), and appropriately changes (selects) the drive voltage (the drive waveform) based on the detected temperature.

Specifically, first, as a voltage conversion step, the liquid droplet ejection head 100 uses the voltage conversion circuit 12S disposed in the relay substrate 12 to convert the resistance value, which changes in accordance with the temperature of the head substrate 10HP, into the output voltage "Vs". Then, as a voltage input step, the liquid droplet ejection head 100 uses the relay substrate 12 to input (transmit) the output voltage "Vs" into the main-body control section 10C via the transmission path 11. Next, as a temperature detection step, the liquid droplet ejection head 100 uses the main-body control section 10C to detect the temperature of the head unit 100U (the head substrate 10HP) based on the input (received) output voltage "Vs".

Here, the main-body control section 10C stores in advance the relationship between the output voltage "Vs" to be input (received) and the temperature "Th" of the head unit 100U. Therefore, it becomes possible for the main-body control section 10C to identify the temperature corresponding to the input (received) output voltage "Vs", and detect the identified temperature as the temperature of the head unit 1000 (the head substrate 10HP).

After that, as a head drive step, the liquid droplet ejection head 100 uses the main-body control section 10C to determine (select) the drive voltage adapted to the detected temperature. Further, the liquid droplet ejection head 100 uses the head control section 13 (the drive Its 10ICa, 10ICb, 10ICc, and 10ICd) to apply the determined drive voltage(s) to the head substrate 10HP, so as to eject liquid droplets from the ejection openings (nozzles) of the head substrate 10HP.

By doing as described above, (the main-body control section 10C of) the liquid droplet ejection head 100 can realize desired ejection characteristics (print quality) in accordance with the temperature "Th" of the head unit 100U. (The main-body control section 10C of) the liquid droplet ejection head 100 can realize desired ejection characteristics (print quality) in accordance with, for example, the temperature of the head substrate 10HP, the temperature (viscosity) of liquid (ink), etc.

When the relay substrate 12 in the liquid droplet ejection head 100 includes the storage section, by comparing the detection result (e.g., the reference potential at the predetermined temperature "Ts") and the output voltage "Vs" stored in the storage section in advance, the temperature "Th" of the head unit 100U may be determined. Further, when the relay substrate 12 in the liquid droplet ejection head 100 includes the storage section, the temperature "Th" of the head unit 100U may be estimated by further using drive history stored in the storage section.

5. Manufacturing Method of the Liquid Droplet Ejection Head

In the liquid droplet ejection head 100 according to an embodiment, the head unit 100U (FIG. 2) is manufactured by stacking (laminating) the head substrate 10HP and the relay substrate 12. Further, the liquid droplet ejection head 100 according to an embodiment is manufactured by electrically connecting the head unit 100U (the relay substrate 12 and the head substrate 10HP) and the main-body control substrate 100C (the main-body control section 10C and the head control section 13) to each other via the transmission path 11 (FIG. 2).

In a method of manufacturing the liquid droplet ejection head 100, as the head substrate 10HP, for example, a silicon substrate, a substrate made of a polyphenylene sulphite (PPS), thermal hardening resin, synthetic resin, engineering plastic, etc., may be used. When the head substrate 10HP is made of a silicon substrate, the liquid chamber and the ejection openings can be formed by anisotropic etching using alkaline etching solution such as calcium hydroxide solution (KOH). Further, the wirings and the circuits of the head substrate 10HP may be formed by using, for example, a photolithography technique, an electroforming process, or a Chemical Vapor Deposition (CVD) method.

In a method of manufacturing the liquid droplet ejection head 100, as the relay substrate 12, for example, a silicon substrate, a substrate made of a polyphenylene sulphite (PPS), thermal hardening resin, synthetic resin, engineering plastic, etc. may be used. Further, in the relay substrate 12 according to an embodiment, the temperature detection unit (e.g., the voltage conversion circuit 12S in FIG. 3) is disposed (formed) (voltage conversion circuit forming step). The temperature detection unit (e.g., the voltage conversion circuit 12S) may be disposed (formed) on the surface of the relay substrate 12 by using, for example, a photolithography technique, an electroforming process, or a Chemical Vapor Deposition (CVD) method.

In a method of manufacturing the liquid droplet ejection head 100, as the main-body control substrate 100C, an arithmetic processing unit including known Central Processing Unit (CPU), memories (Read Only Memory (ROM) and Random Access Memory (RAM)), etc., may be used. Here, the CPU reads an Operating System (OS) and a program from a storage device (e.g., the ROM) and performs logical operations, etc., to control elements and calculate data, process data, etc. The ROM stores a control program, operating conditions, etc. The RAM is used as a working area (a cache memory, a work area) to temporarily store data which are necessary for executing a program.

In a method of manufacturing the liquid droplet ejection head 100, as the transmission path 11, a belt-like cable coated with a resin film may be used. In a method of manufacturing the liquid droplet ejection head 100, as the transmission path 11, an FFC may be used where a plurality of conductive wires are bundled in a belt form and coated with a resin film.

Figure 4:
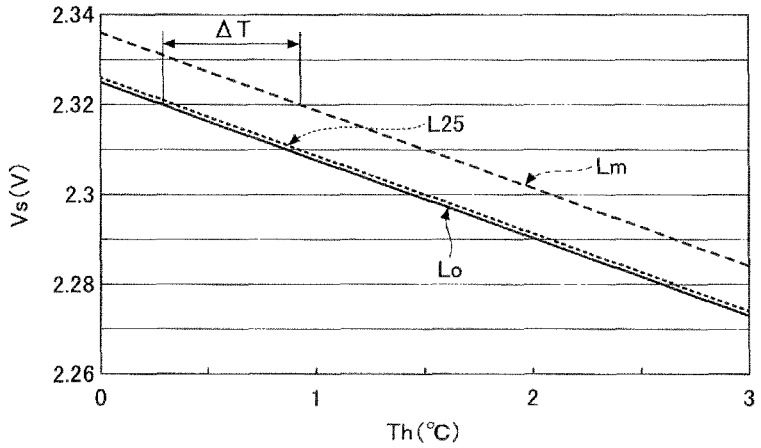
FIG. 4 is a graph illustrating an example of a correction value of the liquid droplet ejection head according to an embodiment.
Figure 5:
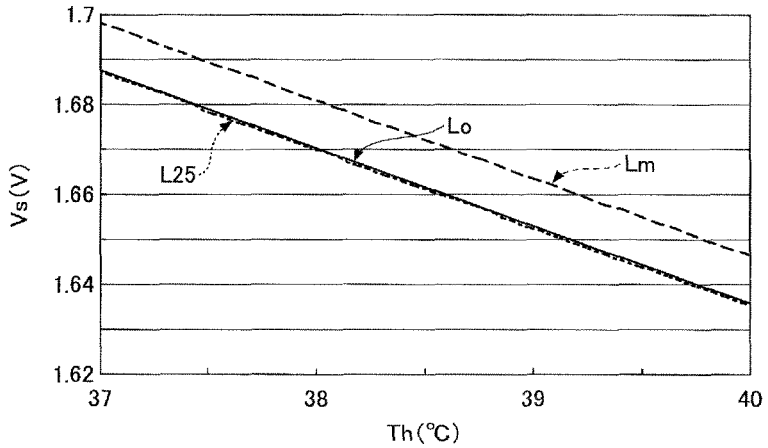
FIG. 5 is a graph illustrating another example of the correction value of the liquid droplet ejection head according to an embodiment.

With reference to FIGS. 4 and 5, a correction value calculation step is described of calculating a correction value which is to be used for detecting the temperature "Th" of the head unit 100U in an adjusting step in a manufacturing method of the liquid droplet ejection head 100. Namely, a step (an adjustment step) is described of cancelling a temperature measurement error due to impedance of the transmission path 11 between the head unit 100U and the main-body control substrate 100C and correcting the variation of the wiring resistance of the head unit 100U and the variation of the parts of the temperature detection unit. FIGS. 4 and 5 illustrates one example of the correction value to be used by the liquid droplet ejection head 100.

As illustrated in FIG. 4, in the liquid droplet ejection head 100, the value of the output voltage "Vs" varies due to variation of parts in the temperature detection unit (the voltage conversion circuit 12S). The voltage "Lm" in FIG. 4 refers to the output voltage "Vs" when, for example, it is assumed that the resistance tolerance (variation of the parts) of the voltage conversion circuit 12S is 0.050 and errors are summed only in the direction of increasing the error amount.

On the other hand, the voltage "Lo" in FIG. 4 refers to the output voltage "Vs" when, for example, the resistance value of the voltage conversion circuit 12S does not include an error. In comparison between the voltages "Lm" and "Lo" in FIG. 4, even when the output voltage of the voltage conversion circuit 12S is the same, there is approximately 0.7 degrees (see "ΔT" in FIG. 4) of difference therebetween due to the resistance tolerance (variation of the parts) of the voltage conversion circuit 12S.

To take the difference in consideration, in a method of manufacturing the liquid droplet ejection head 100 according to an embodiment, the variation of (the part of) the voltage conversion circuit 12S is regarded as the variation of the wiring resistance (e.g., the impedance of the transmission path 11), and the correction value to correct the voltage "Lm" to the voltage "L25" in FIG. 4 is calculated.

Namely, in a method of manufacturing the liquid droplet ejection head 100 according to an embodiment, a single correction value is calculated by further using the resistance value (impedance) of the transmission path 11 electrically connecting between the main-body control substrate 100C and the relay substrate 12 (the head unit 100U) without separating the variation of the parts of the voltage conversion circuit 12S and the variation of the wiring resistance.

In a method of manufacturing the liquid droplet ejection head 100 according to an embodiment, in a step of heating the head unit 100U (e.g., in heating when the relay substrate 12 is sealed), the correction value may be calculated based on the output voltage "Vs" of the temperature detection unit. As the heat step in the method of manufacturing the liquid droplet ejection head 100, for example, as illustrated in FIG. 5, the head unit 100U is heated at a temperature in a range from 37 to 40° C.

In this case, the correction value may be calculated by comparing the voltage "Lm", which is output when the head unit 100U is heated as the heat process in the method of manufacturing the liquid droplet election head 100 (when the resistance value of the voltage conversion circuit 12S includes an error), and the voltage "Lo" (when the resistance value of the voltage conversion circuit 12S does not include an error).

By doing this, in the method of manufacturing the liquid droplet ejection head 100, it becomes possible to measure (calculate) the correction value without adding a heat process to calculate the correction value. Namely, it becomes possible to reduce the manufacturing cost of the liquid droplet ejection head 100.

Further, FIG. 6 illustrates an example output voltage of the temperature detection unit in the liquid droplet ejection head 100. Here, the voltage "La" in FIG. 6 is one example of the output voltage of the voltage conversion circuit 12S according to an embodiment (when the voltage conversion circuit 12S is mounted on the relay substrate 12). On the other hand, the voltage "Lb" in FIG. 6 is another example of the output voltage of the voltage conversion circuit 12S according to an embodiment (when the voltage conversion circuit 12S is not mounted on the relay substrate 12).

As illustrated in FIG. 6, the change amount in the voltage "Lb" relative to the temperature change (when the voltage conversion circuit 12S is not mounted on the relay substrate 12) is (relatively small). Due to this, the voltage "Lb" is subject to influence of noise. On the other hand, the change amount in the voltage "La" relative to the temperature change (when the voltage conversion circuit 12S is mounted on the relay substrate 12) is greater than that in the voltage "Lb".

Namely, by mounting the voltage conversion circuit 12S on the relay substrate 12, it becomes possible to increase the change amount of the voltage (increase the absolute value of the inclination of the voltage in the graph) so as to be less subject to (reduce) the influence of noise.

Figure 7:
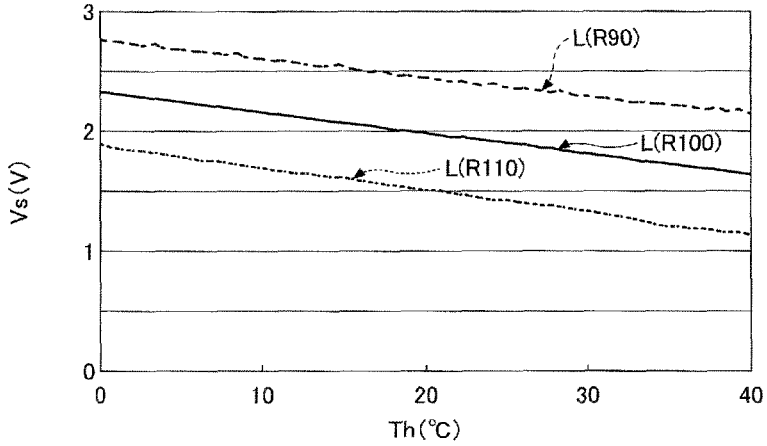
FIG. 7 is a graph illustrating another example of the detection result (output voltage) of the temperature detection unit (voltage conversion circuit) of the liquid droplet ejection head according to an embodiment.

FIG. 7 illustrates the output voltages "Vs" when the wiring resistance of the temperature detection unit (the voltage conversion circuit 12S) in the liquid droplet ejection head 100 is set to 90 Ω, 100Ω, and 110Ω. In FIG. 7, the lines "L(90)", "L(100)", and "L(110)" denote the cases where the wiring resistances are 90 Ω, 100Ω, and 110Ω, respectively. Here, the wiring resistance varies depending on variation in the film pressure of the wirings and in etching process in manufacturing the liquid droplet ejection head 100.

As illustrated in FIG. 7, in comparison among the cases of the lines "L(90)", "L(100)", and "L(110)", there exist a difference of more than 40° C. even at the same output voltage. Namely, it is desired to correct the relationship between the temperature "Th" of the head unit 100U and the output voltage "Vs" in accordance with the variation of the wiring resistance in manufacturing the liquid droplet ejection head 100.

Here, the wiring resistance "R" can be calculated based on the following formula (1):

$$R=100+AT \qquad \text{formula (1)}$$

Where, the symbol "A" denotes a temperature coefficient, and the symbol "T" denotes a detected temperature.

When the wiring resistance of the voltage conversion circuit 12S varies due to a diameter of the wirings, the temperature coefficient "A" is not changed. Due to this, when a resistance change rate is given as "X", the wiring resistance "R" can be expressed in the following formula (2):

$$R=X(100+AT) \qquad \text{formula (2)}$$

Namely, in a method of manufacturing the liquid droplet ejection head 100 according to an embodiment, the resistance change rate "X" is calculated, so that the correction is done in a whole temperature range by using the calculated resistance change rate "X". In a method of manufacturing the liquid droplet ejection head 100 according to an embodiment, for example, at an ordinary temperature such as around 25° C., the temperature "Th" of the head unit 100U and the output voltage "Vs" are measured. Then, the wiring resistance in this case is calculated and a ratio to a target value is calculated, so that the output voltage "Vs" in a range from 0 to 40° C. is corrected based on the calculated ratio. By doing this, in the method of manufacturing the liquid droplet ejection head 100, it becomes possible to detect the temperature "Th" of the head unit 100U.

As described above, in a method of manufacturing (a step of adjusting) the liquid droplet ejection head 100 according to an embodiment, it becomes possible to reduce an error in temperature detection (temperature measurement error) due to the impedance of the transmission path 11 between the head unit 100U and the main-body control substrate 100C. Further, in a method of manufacturing (a step of adjusting) the liquid droplet ejection head 100 according to an embodiment, it becomes possible to correct the variation of the wiring resistance in the head unit 100U and the variation of the parts in the temperature detection unit.

Namely, in a method of manufacturing the liquid droplet ejection head 100 according to an embodiment, in the adjustment step, it becomes possible to correct (1) the variation of the wiring resistance of the transmission path 11, etc., (2) the variation of the temperature detection unit (the voltage conversion circuit 12S), and (3) the variation of the wiring resistance inside the main-body control substrate 100C (the main-body control section 10C, etc.).

Based on the above, in a method of manufacturing the liquid droplet ejection head 100 according to an embodiment, it becomes possible to adjust (correct) the above variations (1) through (3) in a single adjustment process. Therefore, it becomes possible to reduce the manufacturing cost of the liquid droplet ejection head 100.

6. Program and Recording Medium

A program "Pr" according to an embodiment causes a computer to execute the method of controlling an operation of a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method including a voltage conversion step of converting, by a voltage conversion circuit disposed in the relay substrate, a resistance value, which changes in accordance with a temperature of the head substrate, into an output voltage; a voltage input step of inputting, by the relay substrate, the output voltage into the main-body controller; a temperature detection step of detecting, by the main-body controller, the temperature based on the output voltage input to the main-body controller; and a head drive step of determining, by the main-body controller, the drive voltage based on the detected temperature and applying the drive voltage to the head substrate to eject liquid droplets from the ejection openings.

By executing the method, the same effect as that in "4. Control method of the liquid droplet ejection head" can be obtained.

Another program "Pr" according to an embodiment causes a computer to execute the method of manufacturing a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method including a voltage conversion circuit allocation step of allocating a voltage conversion circuit, whose resistance value changes in accordance with a temperature of the head substrate, in the relay substrate; and a correction value calculation step of calculating a correction value associating the temperature of the head substrate with the resistance value of the voltage conversion circuit. Here, in the correction value calculation step, a resistance value of a transmission path, which electrically connects the main-body controller and the relay substrate to each other, is further used to calculate the correction value.

By executing the method, the same effect as that in "5. Manufacturing method of the liquid droplet ejection head" can be obtained.

According to an embodiment, it is possible to provide a (non-transitory and computer-readable) recording medium "Md" storing the above program "Pr". As the recording medium "Md" storing the above program "Pr", a Flexible Disk (PD), a Compact Disk-ROM (CD-ROM), a CD Recordable (CD-R), a Digital Versatile Disk (DVD), other computer-readable media, a semiconductor memory such as a flash memory, a RAM, a ROM, etc., a memory card, a Hard Disk Drive (HDD) or any other computer-readable object may be used.

Here, it is assumed that the recording medium "Md" storing the above program "Pr" includes a server capable of transmitting the program "Pr" via a network and a volatile memory in a computer system as a client of the server. Here, the "network" refers to, for example, a network such as the Internet and a communication line such as a telephone line.

Here, the "volatile memory" refers to, for example, a Dynamic Random Access Memory (DRAM). Further, the program "Pr" stored in the recording medium "Md" may include a so-called differential file which can achieve the functions upon being combined with a program already recorded in a computer system.

According to an embodiment of the present invention, there is provided a method of controlling an operation of a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method including a voltage conversion step of converting, by a voltage conversion circuit disposed in the relay substrate, a resistance value, which changes in accordance with a temperature of the head substrate, into an output voltage; a voltage input step of inputting, by the relay substrate, the output voltage into the main-body controller; a temperature detection step of detecting, by the main-body controller, the temperature based on the output voltage input to the main-body controller; and a head drive step of determining, by the main-body controller, the drive voltage based on the detected temperature and applying the drive voltage to the head substrate to eject liquid droplets from the ejection openings.

Further, according to an embodiment of the present invention, there is provided a method of manufacturing a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method including a voltage conversion circuit allocation step of allocating a voltage conversion circuit, whose resistance value changes in accordance with a temperature of the head substrate, in the relay substrate; and a correction value calculation step of calculating a correction value associating the temperature of the head substrate with the resistance value of the voltage conversion circuit. Further, in the correction value calculation step, a resistance value of a transmission path, which electrically connects the main-body controller and the relay substrate to each other, is further used to calculate the correction value.

Further, according to an embodiment of the present invention, there is provided a program causing a computer to execute the above method of controlling an operation of a liquid droplet ejection head or the above method of manufacturing a liquid droplet ejection head.

Further, according to an embodiment of the present invention, there is provided a recording medium storing the above program.

In a control device of controlling an operation of a liquid droplet ejection head and a method of controlling an operation of a liquid droplet ejection head or a method of manufacturing a liquid droplet ejection head according to an embodiment of the present invention, it becomes possible to detect the temperature based on the output voltage which varies depending on the temperature change or detecting the temperature based on the output voltage.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A control device of controlling an operation of a liquid droplet ejection head, the control device comprising:

a head substrate having a plurality of ejection openings;

a head controller configured to apply a drive voltage to the head substrate to control an operation of ejecting liquid droplets from the ejection openings;

a relay substrate configured to electrically connect the head substrate and the head controller to each other;

a main-body controller configured to control an operation of the head controller; and a voltage conversion circuit disposed in the relay substrate, wherein the voltage conversion circuit is configured to convert a resistance value, which changes in accordance with a temperature of the head substrate, into an output voltage, wherein the relay substrate is configured to input the output voltage into the main-body controller, and wherein the main-body controller is configured to detect the temperature based on the output voltage input to the main-body controller and determine the drive voltage based on the temperature detected by the main-body controller.

2. The control device according to claim 1, wherein the main-body controller is configured to input the output voltage from the voltage conversion circuit via a transmission path.

3. The control device according to claim 1, wherein the main-body controller is configured to detect in advance a reference voltage, which is to be output from the voltage conversion circuit when the head substrate is at a predetermined temperature and detect the temperature by comparing the reference voltage detected in advance by the main-body controller with the output voltage input to the main-body controller.

4. The control device according to claim 3, wherein the relay substrate further includes a storage, wherein the storage is configured to store the reference voltage.

5. The control device according to claim 1, wherein the relay substrate further includes an A/D conversion circuit configured to convert a value of the output voltage into digital data to be input to the main-body controller.

6. A liquid droplet ejection head comprising:

the control device according to claim 1.

7. A method of controlling an operation of a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method comprising:

a voltage conversion step of converting, by a voltage conversion circuit disposed in the relay substrate, a resistance value, which changes in accordance with a temperature of the head substrate, into an output voltage;

a voltage input step of inputting, by the relay substrate, the output voltage into the main-body controller;

a temperature detection step of detecting, by the main-body controller, the temperature based on the output voltage input to the main-body controller; and a head drive step of determining, by the main-body controller, the drive voltage based on the detected temperature and applying the drive voltage to the head substrate to eject liquid droplets from the ejection openings.

8. A non-transitory computer-readable recording medium storing a program causing a computer to execute the method of controlling an operation of a liquid droplet ejection head according to claim 7.

9. A method of manufacturing a liquid droplet ejection head including a head substrate having a plurality of ejection openings, a head controller applying a drive voltage to the head substrate, a relay substrate electrically connecting the head substrate and the head controller to each other, and a main-body controller electrically connected to the relay substrate, the method comprising:

a voltage conversion circuit allocation step of allocating a voltage conversion circuit, whose resistance value changes in accordance with a temperature of the head substrate, in the relay substrate; and a correction value calculation step of calculating a correction value associating the temperature of the head substrate with the resistance value of the voltage conversion circuit, wherein, in the correction value calculation step, a resistance value of a transmission path, which electrically connects the main-body controller and the relay substrate to each other, is further used to calculate the correction value.

10. A non-transitory computer-readable recording medium storing a program causing a computer to execute the method of manufacturing a liquid droplet ejection head according to claim 9.

* * * * *